US005252006A

United States Patent [19]

Plevak

[11] Patent Number: 5,252,006

[45] Date of Patent: Oct. 12, 1993

[54] MINE ROOF SUPPORT

[75] Inventor: Lubomir Plevak, Lunen, Fed. Rep. of Germany

[73] Assignee: Westfalia Becorit Industrietechnik GmbH, Fed. Rep. of Germany

[21] Appl. No.: 15,136

[22] Filed: Feb. 9, 1993

[30] Foreign Application Priority Data

Feb. 27, 1992 [DE] Fed. Rep. of Germany ..... 4205940

[51] Int. Cl.[5] ..... E21D 23/04

[52] U.S. Cl. ..... 405/297; 405/299

[58] Field of Search ..... 405/291, 295, 296, 297, 405/299, 300, 301; 299/31, 33

[56] References Cited

U.S. PATENT DOCUMENTS

| | | | |
|---|---|---|---|
| 3,811,288 | 5/1974 | Wehner | 405/296 |
| 4,311,417 | 1/1982 | Bower et al. | 405/297 |
| 4,600,340 | 7/1986 | Rosenberg | 405/297 |
| 5,039,257 | 8/1991 | Bithell | 405/297 |
| 5,100,263 | 3/1992 | Woodford et al. | 405/297 |

*Primary Examiner*—David H. Corbin

*Attorney, Agent, or Firm*—Samuels, Gauthier & Stevens

[57] ABSTRACT

A mine roof support employs a pair of floor skids carrying hydraulic props on which a roof-engaging structure is mounted. A goaf-shield is pivotably mounted to the roof-engaging structure and is connected with a lever system to the floor skids. A shifting and guide mechanism is disposed between the floor skids and takes the form of an hydraulic ram connected at the rear to a floor rail disposed beneath the ram. The ram is supported at the front end by a bridge member connecting the front ends of the skids together. An hydraulic lifting unit is mounted on the bridge member and when extended the unit bears on the floor rail to partially lift the skids as the shifting ram is operated. The lifting unit can be mounted to the bridge member in one of several alternative height positions. To ensure the lifting unit is always maintained above the lower surface of the bridge member when the lifting unit is retracted a stop piece is mounted beneath the bridge member to effectively provide an extension of the lower surface of the bridge member.

16 Claims, 4 Drawing Sheets

MINE ROOF SUPPORT

FIELD OF THE INVENTION

The present invention relates to a mine roof support particularly a displaceable roof support which can be advanced up towards a mineral face as mineral winning progresses.

BACKGROUND TO THE INVENTION

Mine roof supports are known in a variety of designs. In one form, such a support comprises a pair of floor skids or sills bearing hydraulic props which carry a roof engageable structure and a goaf shield is pivotably supported on the roof engageable structure. To shift the support an hydraulic ram and a floor beam are disposed one above the other between the floor sills. The floor beam is coupled to a scraper-chain conveyor and the shifting ram is operated to advance the support up to the conveyor or to thrust the conveyor forwardly relative to the mineral face. In order to assist the shifting ram, especially in workings where the floor skids are prone to become embedded into the floor, it is known to use a lifting mechanism to raise the skids partially at least at their front end regions when the shifting ram is operated.

Published patent specifications U.S. Pat. No. 4,600,340 and GB-2237837 both described supports of the aforementioned kind. In GB-2237837 the lifting mechanism takes the form of an upstanding piston and cylinder unit which is connected to a bridge member which interconnects the floor skids and extends over the space between the floor skids. By extending the unit the unit engages on the floor beam to press this against the floor to partially raise the skids. It is generally desirable to provide a structure which is able to be adapted to the nature of the prevailing conditions without necessitating an hydraulic lifting unit of excessive length. In GB-2237837 provision is made to secure the lifting unit to the bridge member in alternative positions. Even when the unit is fully retracted the unit can still contact the floor beam if the floor skids sink into the floor and damage and distortion can occur.

A general object of the present invention is to provide an improved roof support.

SUMMARY OF THE INVENTION

In accordance with the invention, the hydraulic lifting unit is connectable with the bridge member in a variety of height positions to cope with different floor conditions as is known but a movable or detachable stop member is usable to alter the heights of the lower surface of the bridge member so that in all locations of the lifting unit when the lifting unit is fully retracted it does not extend below the lower surface of the bridge member or the lower surface as extended downwardly by the stop member. This ensures that when the support has been set with the hydraulic props braced against the roof and the lifting unit is not in operation and is accordingly fully retracted the unit will never be able to contact the floor beam of the shifting mechanism even if the floor skids sink deeply into the floor.

The vertical adjustability of the lifting unit can be achieved in a stepless or in an incremental way. In the latter case, which may be simpler to effect, two or three steps or alternative positions will be sufficient. The steps are preferably equal and can be defined by spaced bores in the bridge member. The associated stop member can be mounted to the bridge member also for adjustment vertically or pivotably in such a way that it can be lowered or pivoted into a working position where is projects below the bridge member or raised or pivoted into an in operative position where it is clear of the lower surface of the bridge member. Alternatively the stop member can be a component detachably mounted, e.g. to the bridge member. In this case, the stop member can be best constructed as a transposable component with a lower limiting surface which can be set at a selected height below the bridge member. The stop member can have a width about the same as the space between the floor skids. To locate the stop member in position beneath the bridge member a tongue and groove type connection can be adopted and the stop member can be retained by a detachable locking piece.

In a preferred construction the lifting unit has its piston rod pivotably connected to a slidable guide member which partly surrounds the unit and is slidably guided for raising and lowering. The guide member can then be securable to the bridge member by engaging bolts or screws or pins in selectively alignable bores of the bridge member and the guide member. The arrangement can be such that in its upper position the guide member will bring the lifting unit up above the lower surface of the bridge member whilst in lower positions the guide member will hold the lifting unit above the lower surface of the stop member which is fitted beneath the bridge member.

Although the floor skids can be rigidly connected to the bridge member it is feasible to have the floor sills individually adjustable relative to one another.

The lifting unit can be operated hydraulically by a control system so that it is always fully retracted when the support has been set and only extends when shifting is to occur.

The invention may be understood more readily, and various other aspects and features of the invention may become apparent, from consideration of the following description.

BRIEF DESCRIPTION OF DRAWINGS

An embodiment of the invention will now be described, by way of example only, with reference to the accompanying drawings, wherein.

DESCRIPTION OF PREFERRED EMBODIMENT

Figure 1:
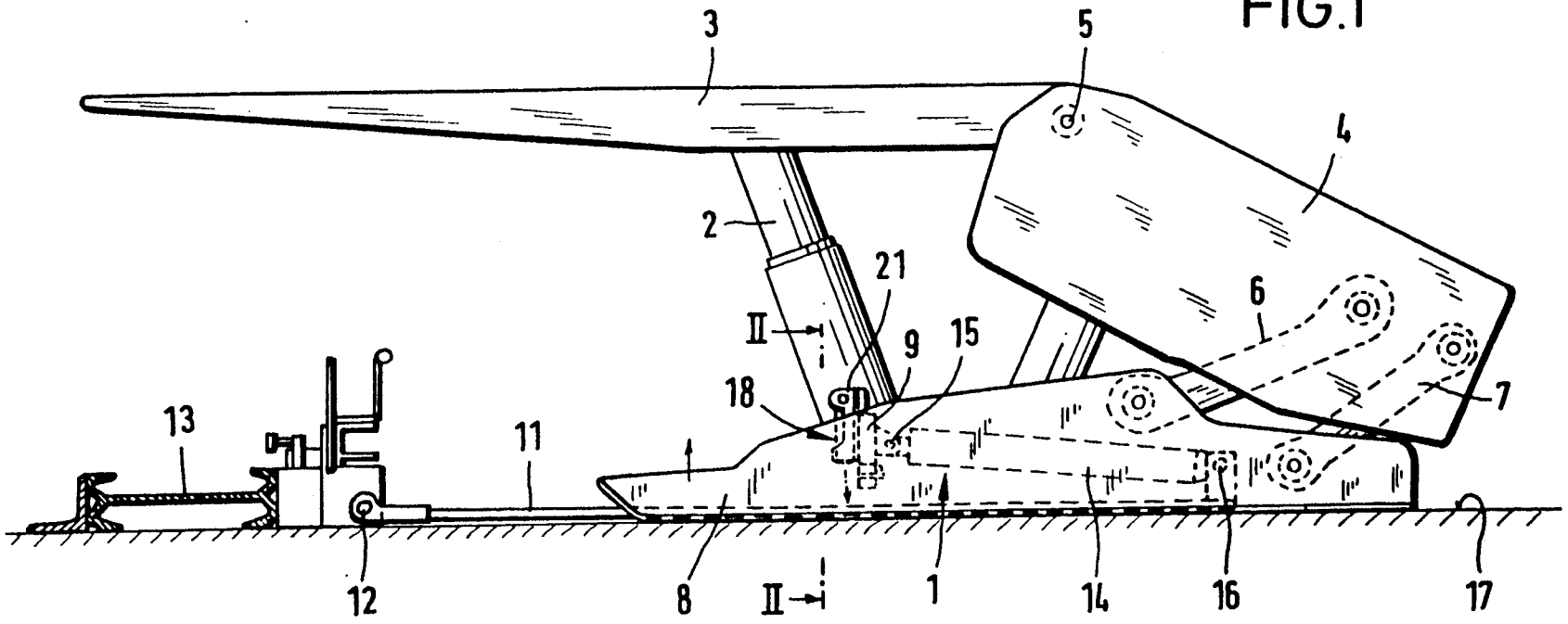
FIG. 1 is a side view of a mineral mining installation and a support constructed in accordance with the invention.

As represented in FIG. 1, a mineral mining installation employs a scraper-chain conveyor 13 composed of a series of channel sections or pans joined end-to-end and along which is moved a scraper-chain assembly (not shown). The conveyor 13 is disposed alongside a mineral, e.g. coal, face and a number of roof supports are disposed alongside the goaf side of the conveyor 13 remote from the mineral face. One of the roof supports is shown in FIG. 1. The support is composed of a floor-engaging structure 1, a roof-engaging structure 3 and hydraulic props 2 therebetween. A goaf shield 4 is pivotably connected as at 5 to the roof-engaging structure 3. A guide linkage 6, 7 is pivotably connected between the shield 4 and the floor-engaging structure and as is known the linkage 6, 7 forms a so-called lemniscate guide means to guide the pivotable motion of the shield 4 as the roof-engaging structure 3 is raised and lowered in the same orientation.

The floor-engaging structure 1 takes the form of two parallel floor skids 8 which are spaced apart and to which the props 2 are connected with articulated joints. The skids 8 are connected together at their ends nearest the conveyor 13 with the aid of a bridging member 9. In the space 10 between the skids 8 there is a shifting mechanism which serves to advance the support and the conveyor 13 in alternate step-like movements as is known.

The shifting mechanism employs a hydraulic ram 14 connected with a pivot joint 15 to the bridge member 9 and with a pivot joint 16 to a flexible resilient guide rail or beam 11. The beam 11 extends along the space 10 to project beyond the floor skids 8 to connect with a pivot joint 12 to structure connected to the goaf side of the conveyor 13. The beam 11 can rest on the floor of the mine working and the ram 14 is disposed above the beam 11. The shifting mechanism 14, 11 is represented in the drawing on simplified schematic outline and in general the mechanism can take the form described in U.S. Pat. No. 4,600,340.

The support is also provided with a lifting mechanism or device for lifting the front regions of the floor skids 8. As shown in FIGS. 2, 4 to 7, this lifting device is composed of an hydraulic piston and cylinder unit 18 with a piston rod head piece 19 connected with a pivot joint 20 to a guide member 21 which is guided for sliding in an up and down sense in a guide 22 disposed on the side of the bridge member 9 nearest the conveyor 15.

The guide 22 can take the form of a pair of parallel guide bars fixed to the bridge member 9 and engaging the guide member 21 in the manner of a drawer. As shown, particularly in FIGS. 5 and 7, the guide member 21 partly surrounds the cylinder of the unit 18. The lower end of the cylinder of the unit 18 is provided with a foot abutment 23 which when the unit 18 extends moves downwardly towards the beam 11.

The guide member 21 with the unit 18 suspended therefrom is connectable at different height positions relative to the bridge member 9 as signated in FIGS. 2, 4, 6 and 7 by references I, II and III with steps of about 50 mm. The adjustment is effected by sliding the guide member 21 along the guide 22 and by fitting element such as bolts, screws or pins 24 into aligned holes in the guide member 21 and an upper extensions 25 of the bridge member 9.

Figure 2:
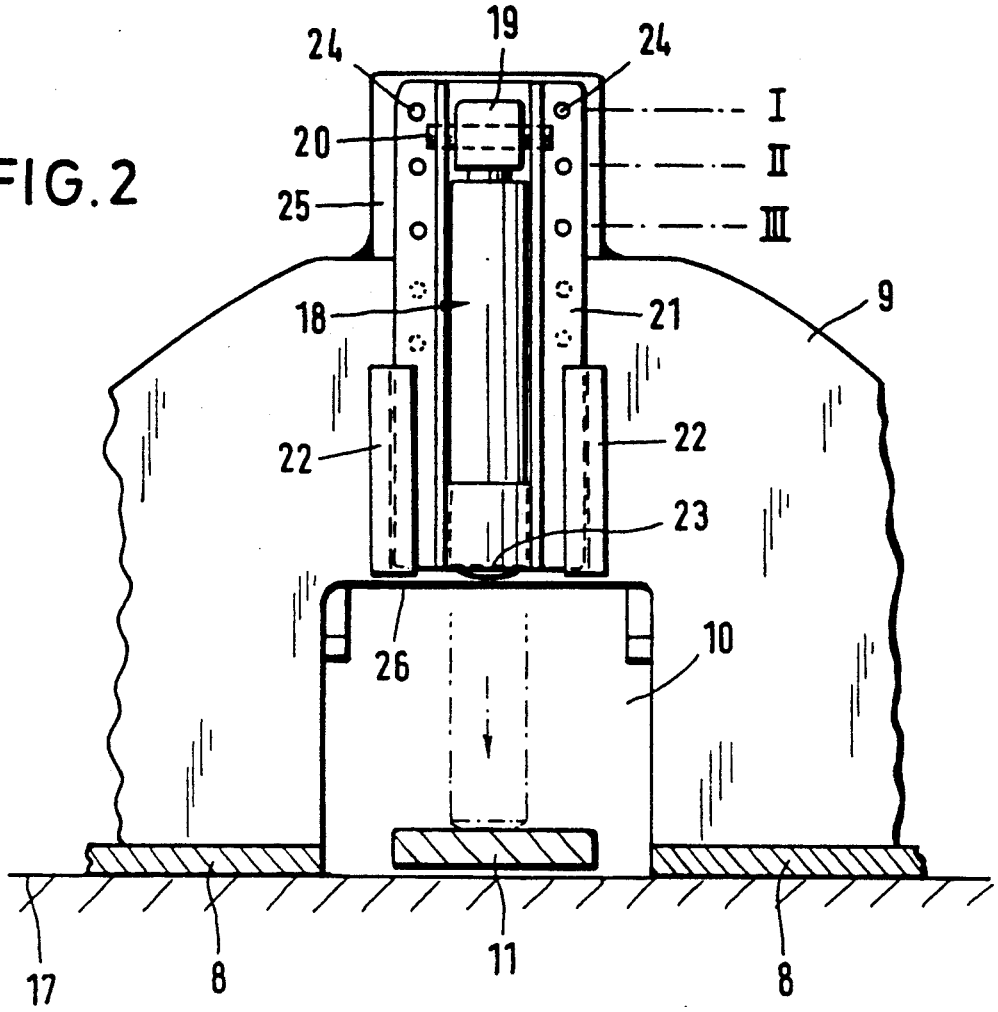
FIG. 2 is an end view of part of the support taken along the line II—II of FIG. 1 and on a somewhat larger scale.
Figure 4:
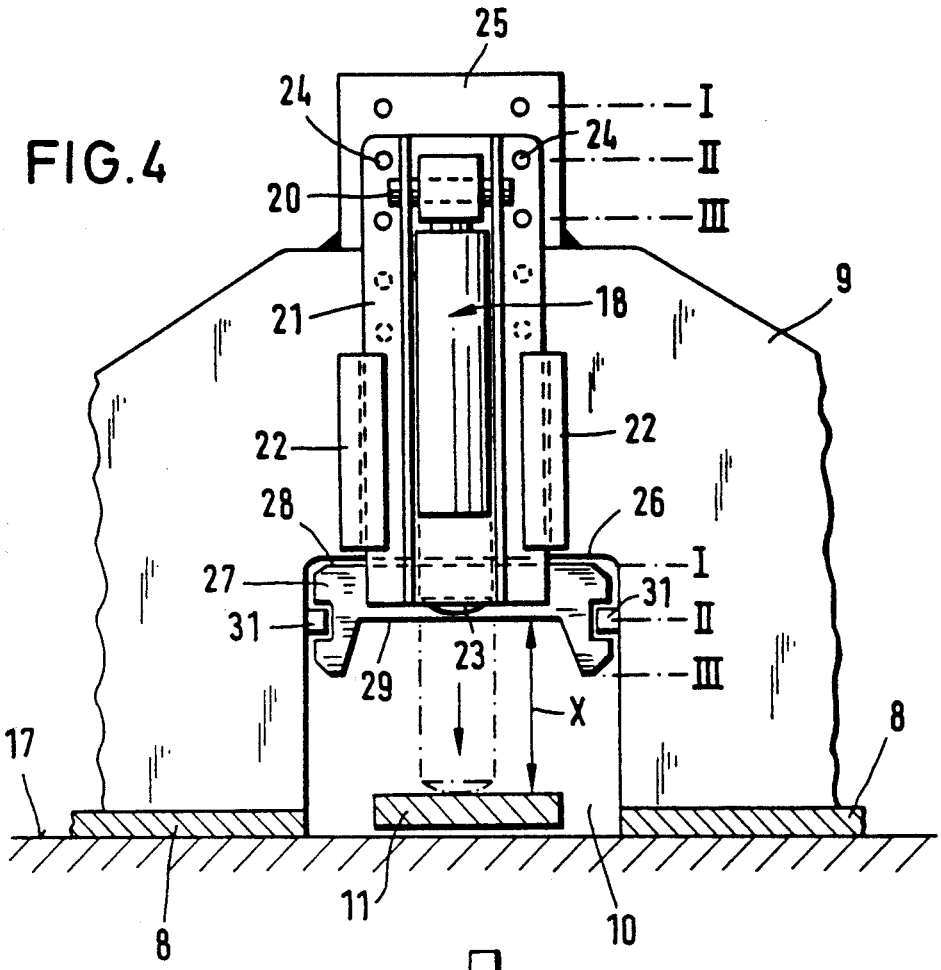
FIG. 4 is an end view corresponding to FIG. 2 but showing the arrangement of the floor skid lifting mechanisms and the stop member.
Figure 6:
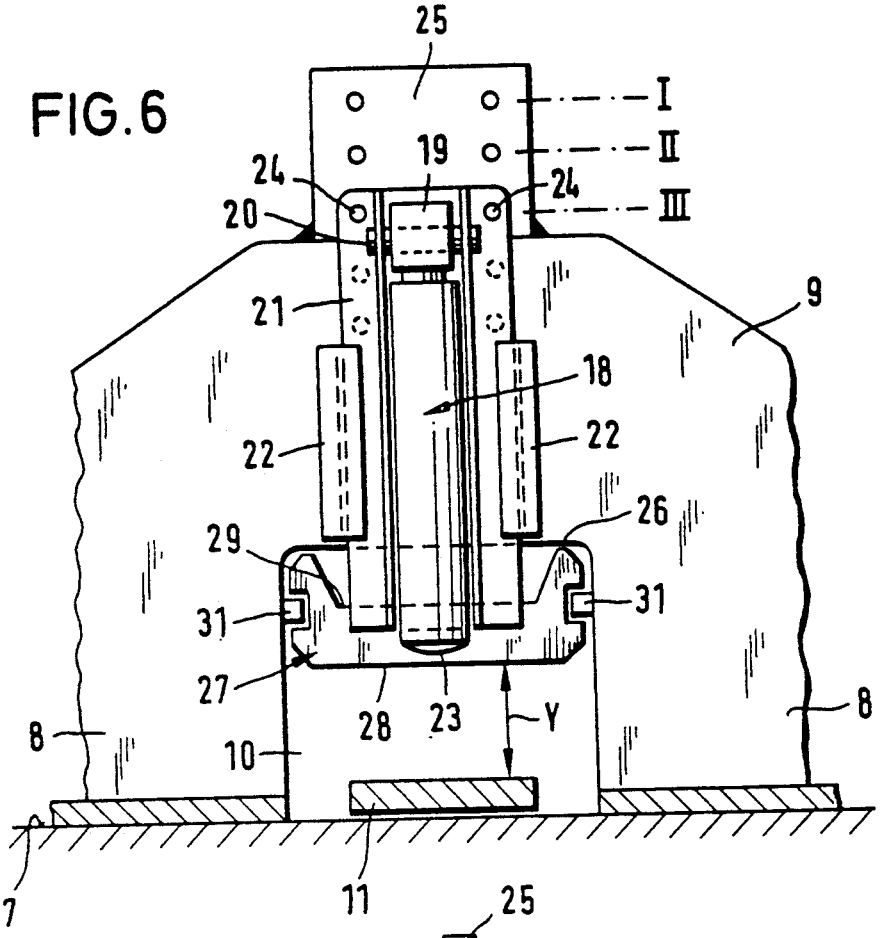
FIG. 6 is an end view corresponding to FIG. 4 but shown the arrangement in a different operating position.
Figure 7:
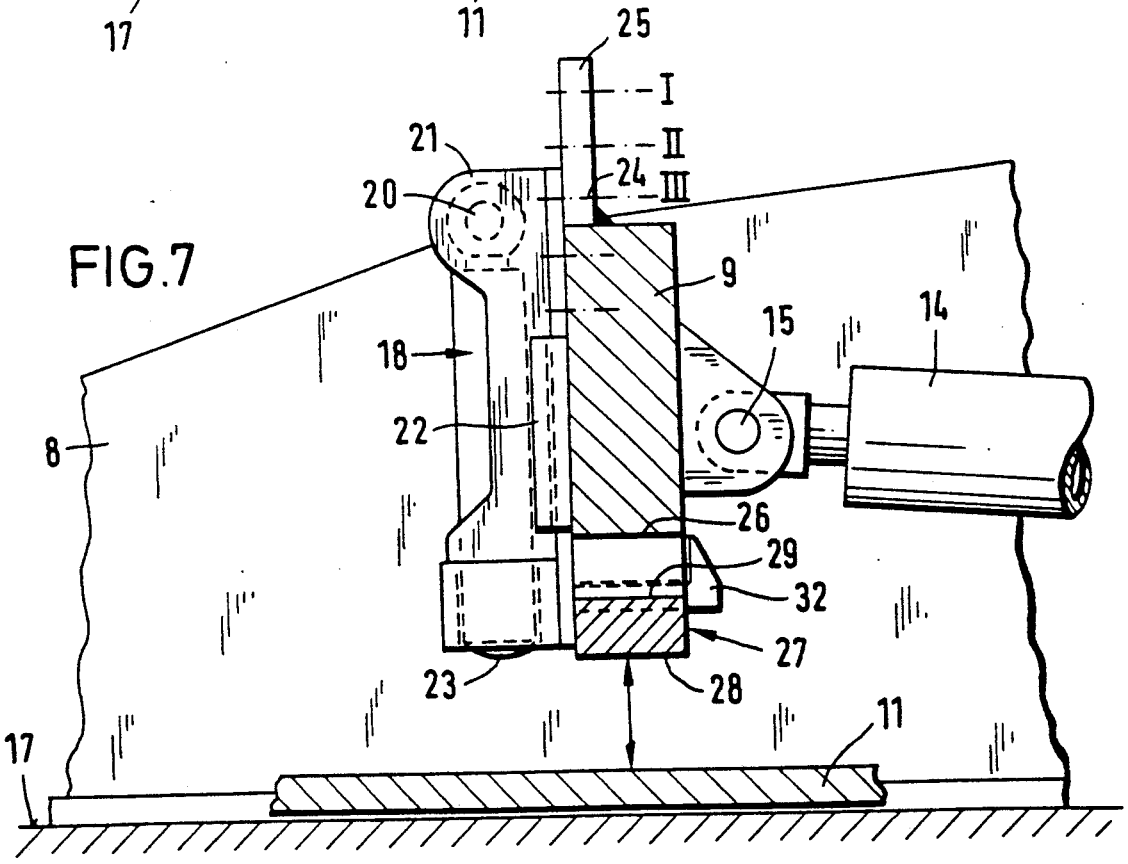
FIG. 7 is a part-sectional side view of the arrangement as shown in FIG. 6.

In FIG. 2 the unit 18 is shown in the highest location I relative to the bridge member 9, in FIG. 4 the unit 18 is shown in the intermediate location II and in FIG. 6 the unit 18 is shown in its lowest location III.

In the highest location I of FIG. 2, the foot abutment 23 with the unit 18 fully retracted does not extend below the lower face 26 of the bridge member 9. In this operating state the floor skids 8 are in face-to-face contact with the floor 17 of the working and the load on the roof-engaging structure 3 acts via the props 2 on the floor-engaging structure I to exert pressure via the skids 8 on the floor 17. When the floor 17 is soft and uneven it is possible from the skids 18 to sink into the floor 17 until the lower face 26 of the bridge member 9 engages on the beam 11. Since the unit 18 and the guide member 21 are disposed above the face 26 however these components do not contact the beam 11 and damage is precluded.

Figure 3:
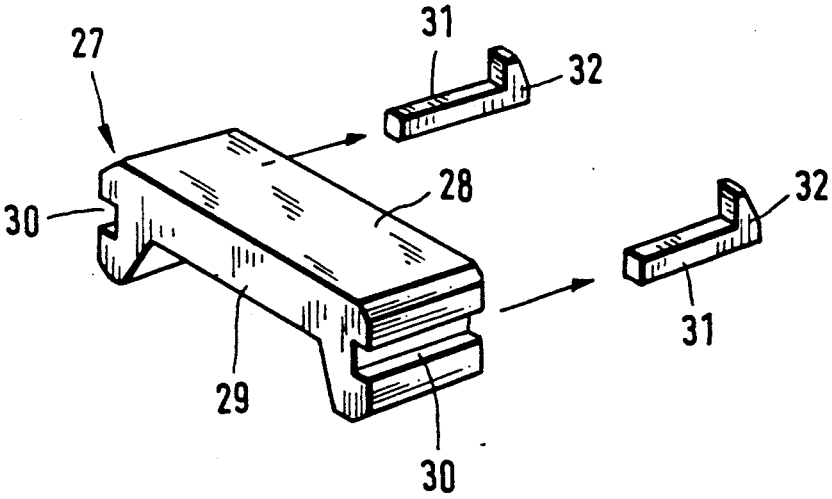
FIG. 3 is a perspective exploded view of a stop member used in the support.
Figure 5:
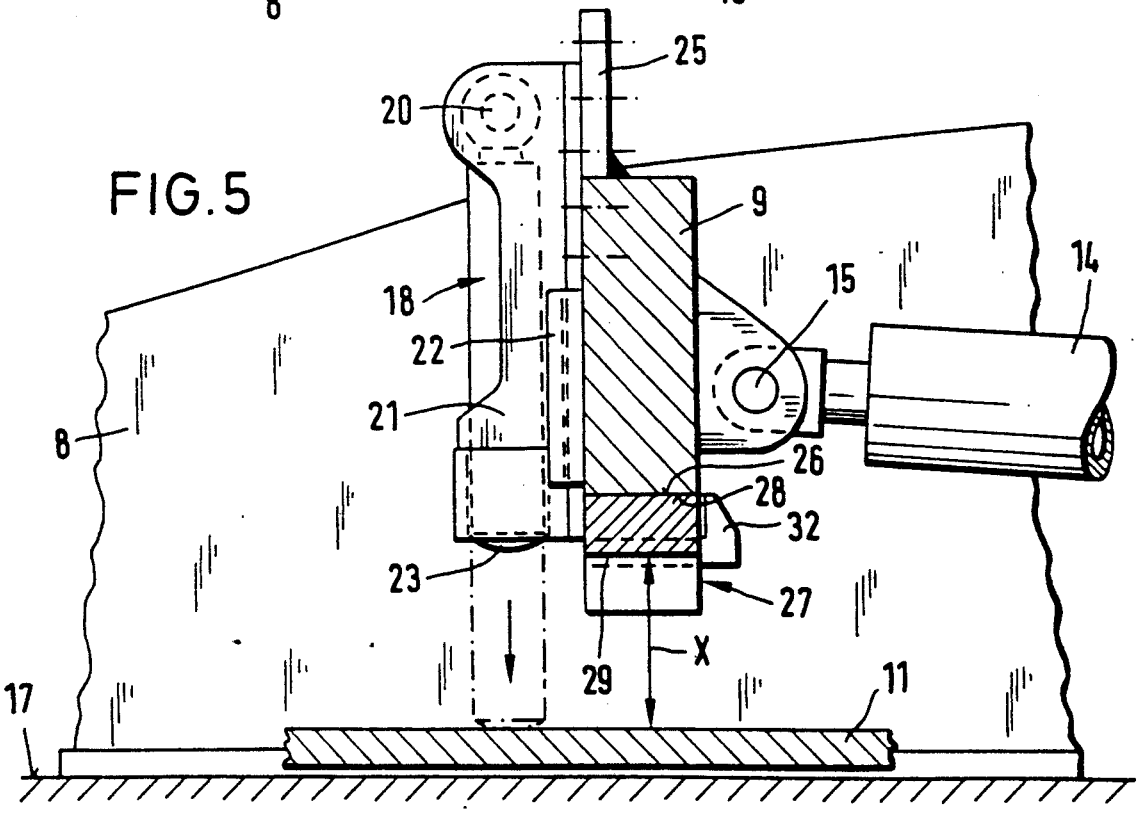
FIG. 5 is a part-sectional side view of the arrangement as shown in FIG. 4.

In the operating state shown in FIGS. 4 and 5 the unit 18 and the guide member 21 adopt the intermediate position II with respect to the bridge member 9. In this position II, the unit 18 and the guide member 21 project downwardly beyond the lower face 26 of the bridge member 9 by the adjustment distance i.e. approximately 50 mm and the unit 18 and the guide member 21 could engage on the beam 11 as the skids 8 sink into the floor 17. To preclude this, a detachable stop member 27 (FIG. 3) is fitted to extend the face 26 the bridge member 9. The member 27 engages adjacent the face 26 and effectively extends this face downwardly by approximately the adjustment distance. As shown in FIG. 3, the stop member 27 takes the form of a U-shaped body with a main portion having upper and lower faces 28, 29. The side portions of the body have centrally-located grooves 30 therein. The member 27 can be positionally inverted with the surf ace 28 or 29 at the top. The overall width of the stop member 27 is approximately the same as the width of the space 10 between the skids 8, the thickness of the reduced main portion of the stop member 27 is approximately the same as the adjustment distance but the overall height of the member 27, corresponding to the length of the side portions, is approximately twice the adjustment distance.

In order to secure the stop member 27 to the bridge member 9 a mounting is provided. This mounting combines with the grooves 30 as tongue-and-groove connections. The mounting thus take the form of a pair of bars 31 which are fixed to opposed faces of the skids 8 in alignment with one another. The stop member 27 can then be engaged in either position with the bars 31 fitting into the grooves 30. The rear ends of the bars 31 have upwardly extending portions 32 which form abutments to locate the stop member 27 in position. The stop member 27 is retained in position by the guide member 21 and the unit 18 which extends over the front end of the member 27 when the guide member 21 and the unit 18 adopt the position II or III. Assume the stop member 27 is fitted with its face 28 adjacent the face 26 of the bridge member 9 and the unit 18 and the guide member 21 are in the position II as represented in FIGS. 4 and 5. Now if the skids 8 sink into the floor 17 by a distance X the stop member 27 will come to engage with its lower face 29 on the beam 11. Because the unit 18 and the guide member 21 are offset upwardly above the face 29 of the stop member 27 when the unit 18 is fully retracted these components cannot contact the beam 11.

When the unit 18 and the guide member 21 adopt the lowest position III the stop member 27 is inverted so that the side portions project upwardly and can rest on or lie adjacent to the face 26 of the bridge member 9 with the face 28 directed downwardly. The distance Y between the face 28 and the beam 11 is smaller than the distance X by about the adjustment step i.e. 50 mm. Similarly to before, if the skids 18 sink into the floor 17 then the face 28 of the stop member 27 will contact the beam 11 to protect the unit 18 and the guide member 21.

It can be appreciated that by mounting the stop member 27 in alternative positions when desired the lifting mechanism or device can be protected in any of the positions I, II or III. In general, if the floor is particularly hard then the stop member 27 is used and the position III represented in FIGS. 6 and 7 will be more suitable. In contrast, if the floor is particularly soft then the stop member 27 can be removed and the position I as in FIG. 2 should be adopted. The arrangement constructed as described makes it possible to use a unit 18 as the lifting device which has a comparatively small stroke over the entire range of expected conditions.

The operation of the lifting device is otherwise well known per se. By applying pressure fluid to the unit 18, the unit can be extended downwardly to cause it to engage and support itself with its foot abutment 23 on the beam 11 and thence the skids 8 will become raised at the front end regions nearest the conveyor 13. The support can then be shifted up towards the conveyor 13 by means of the ram 14. When the support has been reset against the roof the unit 18 is fully retracted as shown in the drawings.

I claim:

1. In a mine roof support with a pair of spaced-apart floor-engageable skids, a roof-engageable structure, hydraulic prop means operably disposed between the skids and the roof-engageable structure, a shifting and guide means composed of a floor rail and a shifting ram disposed above the floor rail for advancing the support relative to a mineral face, a bridge member interconnecting front end regions of the skids relative to a mineral face, a lower surface of the bridge member being disposed above the floor rail and in confronting relationship thereto and a lifting mechanism comprising an upstanding piston and cylinder unit, the unit being extendible to engage on the floor rail to effect at least partially raising of the skids when the shifting ram is operated to advance the support, and means for detachably connecting the unit to the bridge member in a plurality of alternative height positions relative to the bridge member; the improvement comprising a stop member operably associated with the bridge member to provide a lower surface below that of the bridge member in confronting relationship to the floor rail to ensure when the unit is retracted it is maintained above the lower surface of the bridge member or the stop member in all the alternative positions of the unit.

2. A support according to claim 1, wherein the stop member is detachably mounted to the bridge member.

3. A support according to claim 1, wherein the stop member is usable to provide alternative lower surfaces at different spacings from the lower surface of the bridge member.

4. A support according to claim 2, wherein the stop member is transposable in relation to the bridge member to provide alternative lower surfaces at different spacings from the lower surface of the bridge member.

5. A support according to claim 4, wherein the support member is a block which is substantially of inverted U-shape or U-shape as viewed from the mineral face.

6. A support according to claim 2, wherein there is provided tongue-and-groove connections for locating the stop member beneath the lower surface of the bridge member.

7. A support according to claim 6, wherein the tongue-and-groove connections are formed by grooves in the stop member and bars fitted to the mutually facing sides of the floor skids.

8. A support according to claim 2 and further comprising abutment means for locating the stop member in position relative to the bridge member.

9. A support according to claim 8, wherein the bars are provided with stop means remote from the mineral face to locate the stop member in position relative to the bridge member.

10. A support according to claim 1, wherein the unit is connected to a guide member which is slidably received for up and down movement by a guide on the bridge member.

11. A support according to claim 10, wherein the detachable connecting means comprises alignable bores in the guide member and the bridge member and locking elements for engaging in said bores to secure the guide member to the bridge member in the alternative height positions of the unit.

12. A support according to claim 10, wherein the guide member at least partially surrounds the unit.

13. A support according to claim 10, wherein the guide member is mountable to extend below the lower surface of the bridge member to retain the stop member in position.

14. A support according to claim 1, wherein the stop member is a block with width corresponding to the spacing between the floor skids and a thickness commensurate with the spacing between the alternative height positions.

15. A support according to claim 1, wherein the stop member is mounted for displacement to adopt different operating positions with respect to the bridge member.

16. A support according to claim 9, wherein the unit is connected to a guide member which is slidably received for up and down movement by a guide on the bridge member and wherein the guide member is mountable to extend below the lower surface of the bridge member to cooperate with the stop means in retaining the stop member in its operating position.

* * * * *